United States Patent [19]

Matsui

[11] Patent Number: 4,594,845

[45] Date of Patent: Jun. 17, 1986

[54] FLY REMOVING SYSTEM FOR SPINNING WINDER

[75] Inventor: Isamu Matsui, Kyoto, Japan

[73] Assignee: Murata Kikai Kabushiki Kaisha, Japan

[21] Appl. No.: 629,264

[22] Filed: Jul. 10, 1984

[30] Foreign Application Priority Data

Jul. 11, 1983 [JP] Japan ..... 58-126481

[51] Int. Cl.[4] ..... D01H 11/00; D01H 15/00

[52] U.S. Cl. ..... 57/304; 242/35.5 R; 15/301

[58] Field of Search ..... 57/301, 304, 305; 15/301; 242/35.5 R

[56] References Cited

U.S. PATENT DOCUMENTS

| | | | |
|---|---|---|---|
| 3,154,904 | 11/1964 | Furst | 242/35.5 R X |
| 3,305,184 | 2/1967 | Seress et al. | 242/35.5 R |
| 3,429,745 | 2/1969 | Black | 242/35.5 R X |
| 3,523,413 | 8/1970 | Ford et al. | 57/304 X |
| 4,181,228 | 1/1980 | Hashimoto et al. | 242/35.5 R X |
| 4,333,201 | 6/1982 | Rohner | 57/304 X |
| 4,484,434 | 11/1984 | Rummele | 57/304 |
| 4,486,616 | 12/1984 | Morita et al. | 242/35.5 R X |

*Primary Examiner*—Donald Watkins

*Attorney, Agent, or Firm*—Spensley Horn Jubas & Lubitz

[57] ABSTRACT

Fly waste removing system for the spinning winder which has a spinning frame and a winder connected to each other. A common cleaner having ducts is run between a spinner area and a winder area to blow off or suck the fly wastes by applying air from air injection and/or air suction ports of the ducts.

12 Claims, 9 Drawing Figures

FLY REMOVING SYSTEM FOR SPINNING WINDER

BACKGROUND OF THE INVENTION

1. Field of the Invention The present invention relates to a fly waste removing system for the so-called "spinning winder" which has a spinning frame and a winder connected to each other.

2. Prior Art

In the spinning frame or the winder, a yarn to be processed is called the "spun yarn" which is produced by drafting a sliver and twisting single fibers of the drafted sliver. A number of flies are made and scattered in the air or deposited on the machine to adversely affect the working circumstances in the manufacturing process of the spun yarns. Furthermore, the flies are caught by the yarn to degrade the yarn quality.

Generally, therefore, a duct formed with an air suction or injection port is run along each table of each of the spinning frames or the winders to prevent the flies from being caught by the machine table or from being scattered in the air.

On the other hand, in the case of the spinning winder in which the spinning frame and the winder are connected in parallel or series to each other, it is uneconomic to provide each spinning frame or winder with a fly waste removing device. This bad economy is prominent especially in the spinning winder which is suitable for multi-kind and small-quantity productions.

SUMMARY OF THE INVENTION

An object of the present invention is to provide a fly waste removing system which is suitable for the spinning winder and is equipped with such a cleaner as is enabled to circulate or reciprocally move across a spinner area and a winder area.

According to the present invention, the common cleaner having the ducts is run between the spinner and winder areas of the spinning winder, and the positions in which the air is injected from and/or sucked in the ducts are made different for the spinner area and the winder area. As a result, the air can be economically acted upon the predetermined portions of each machine by the common cleaner without arranging a blower, a duct and so on in each area. In the intermediate area between the spinning frame and the winder, moreover, the portions in which the floating flies are liable to deposit can be cleaned so that a wider range can be cleaned than in case each machine is equipped with the cleaner.

DETAILED DESCRIPTION OF THE INVENTION

The present invention will be described in the following in connection with the embodiment thereof with reference to the accompanying drawings.

Figure 2:
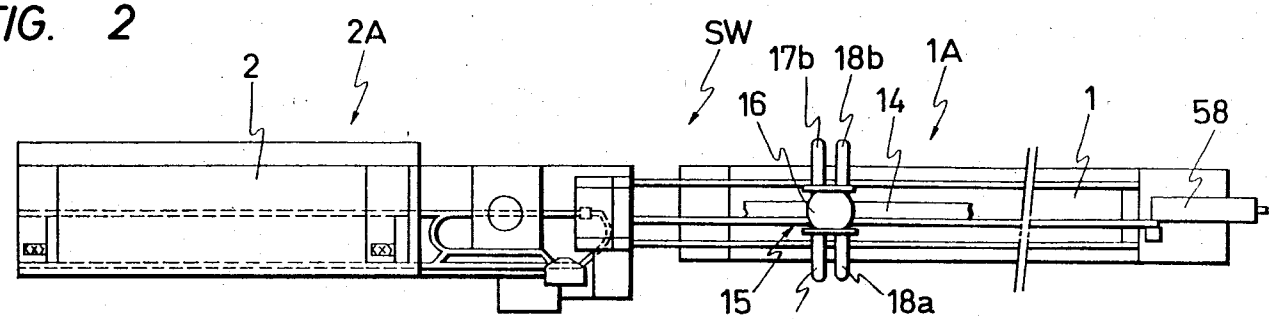
FIG. 2 is a top plan view of the same.
Figure 1:
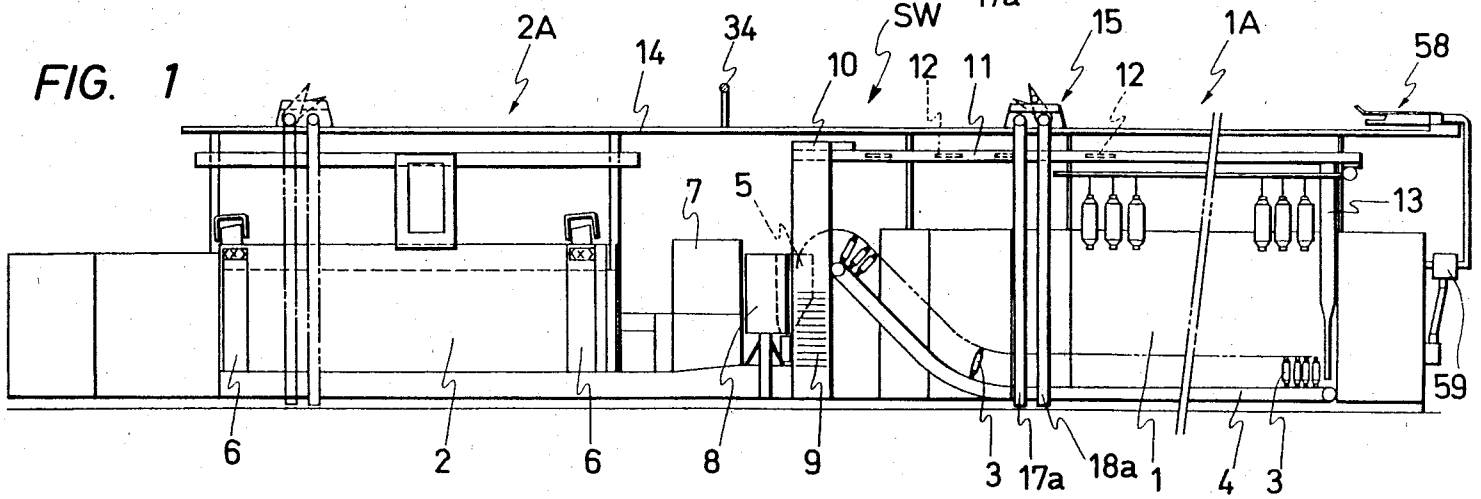
FIG. 1 is a front elevation showing one example of the layout of the spinning winder to which the system of the present invention is applied.

FIG. 1 shows an example of the layout of the spinning winder. In the present embodiment, specifically, a spinning frame 1 and a winder 2 are arranged in series. Spinning bobbins 3 having taken-up yarns produced by the spinning frame 1 are conveyed in the longitudinally in front of the spinning frame and thrown in a bobbin feeder 5, while being fitted on and supported by pegs on a transport band 4, for example, so that they are fitted upright one by one separately and independently on carriers being conveyed on bobbin conveying means such as a belt conveyor standing by therebelow until they are fed to each of winding units 6 at the side of the winder 2. Indicated at numeral 7 is a readying unit which is equipped with either a pick finding device for releasing the trailing end of the bobbin yarn on the spinning frame or a device for detecting whether the yarn is left on the bobbin or not.

The feed of the spinning bobbins to each winding unit of the aforementioned winder 2 is conducted by the method of the type in which the spinning bobbins are individually fed, while being fitted on the carriers, to the winding position of each winding unit or in which the spinning bobbins are conveyed, while lying on the conveyor, so that they are fed to a bobbin storage magazine of each winding unit.

The empty bobbins or bobbins with residual yarns, which have been completed with their winding operations, are conveyed by the empty bobbin transporting conveyor lying along the winding units so that the empty bobbin and the bobbins with residual yarns are selected by a bobbin treating device 8. The empty bobbins are conveyed vertically upward by an empty bobbin elevator 9 and are transferred from a chute 10 located at an upper end to an empty bobbin conveyor 11, which is disposed above the spinning frame 1, until they are horizontally conveyed above the spinning frame. The empty bobbins 12 thus conveyed to the end portion of the spinning frame 1 drop into a chute 13 and are stored therein until they are timed to be fed to and fitted on the empty pegs on the transport band 4 located therebelow.

Thus, the spinning frame 1 and the winder 2 are connected by means of the spinning bobbin passage and the empty bobbin passage.

In the spinning winder thus far described, there is laid a ceiling rail 14 which extends in the longitudinal direction between a spinner area 1A and a winder area 2A, and a cleaner 15 is placed along said rail 14 and is made reciprocally movable to the right and left to inject compressed air and/or to suck air to predetermined portions of the spinning frame and the winder from air injection ports and/or air suction ports which formed in suitable positions of ducts 17*a*, 17*b*, 18*a* and 18*b* leading from a blower 16.

Figure 3:
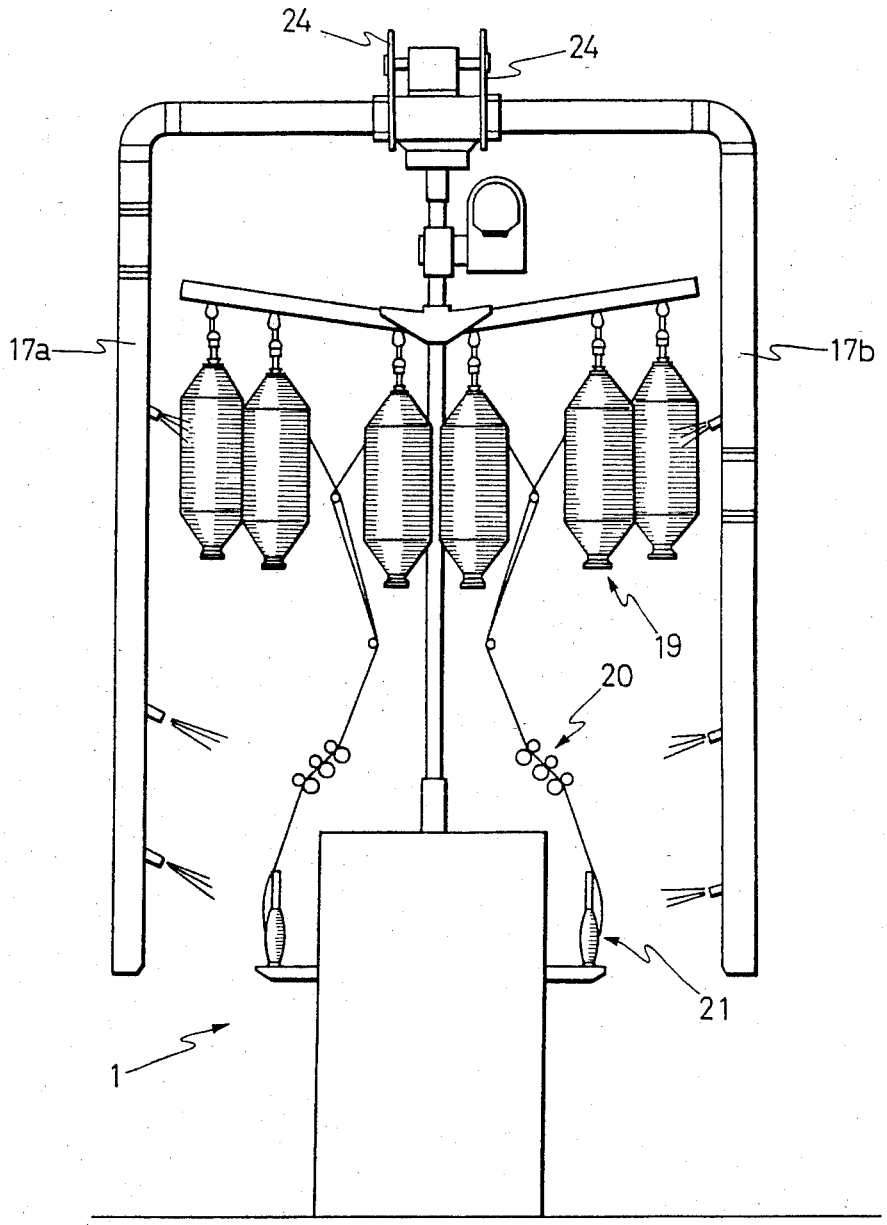
FIG. 3 is a side elevation showing the air injection positions of the spinner area.
Figure 4:
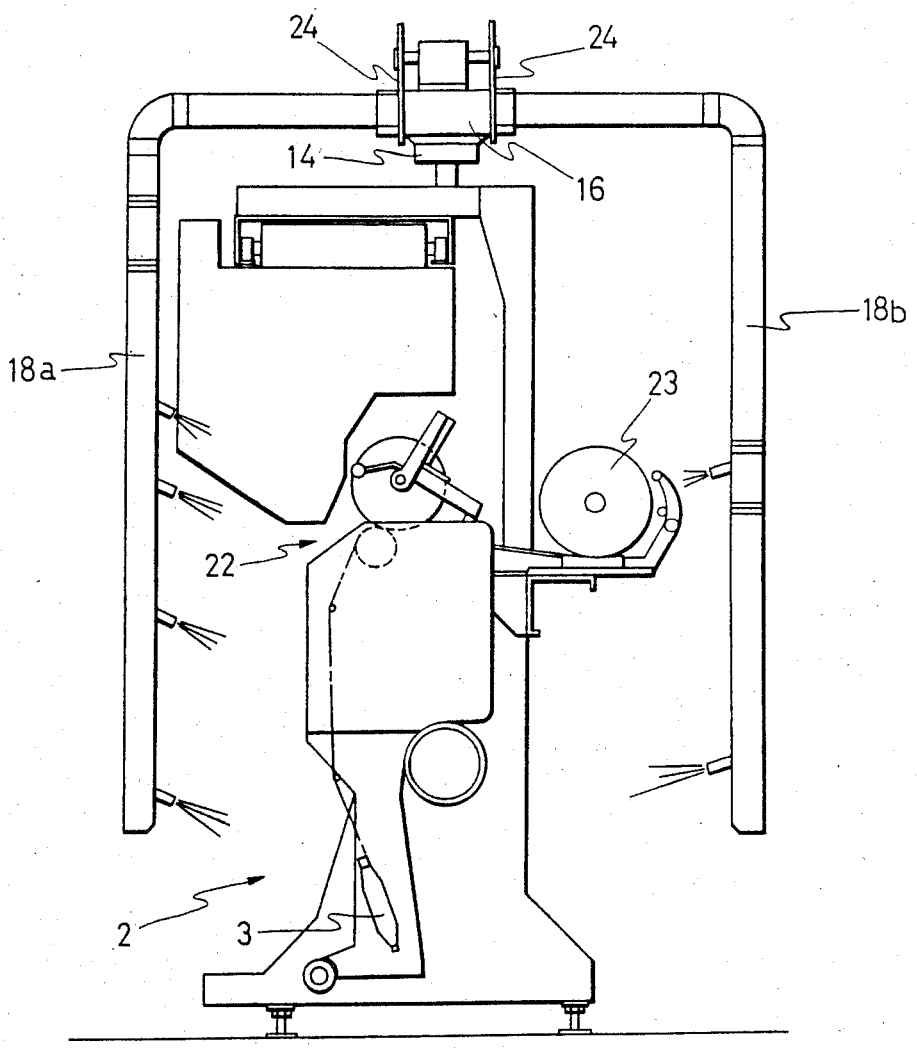
FIG. 4 is a side elevation showing the air injection positions of the winder area.

Of these ducts, the ducts 17*a* and 17*b* act in the spinner area 1A, and the ducts 18*a* and 18*b* act in the winder area 2A. As shown in FIGS. 3 and 4, specifically, the spinning frame 1 and the winder 2 are different in their heights and in their portions where the flies are liable to float. In the spinning frame 1, for example, the flies are liable to float in the vicinity of a sliver feeder 19, a draft part 20, a take-up spindle 21 and so on. In the winder 2, on the other hand, air is injected and/or sucked to prevent the flies from being caught by the yarn and seeking and picking portions of the spinning bobbins, the wind-up portions 22 of the winding units, tensers, slub catchers or doffing packages 23.

Figure 5:
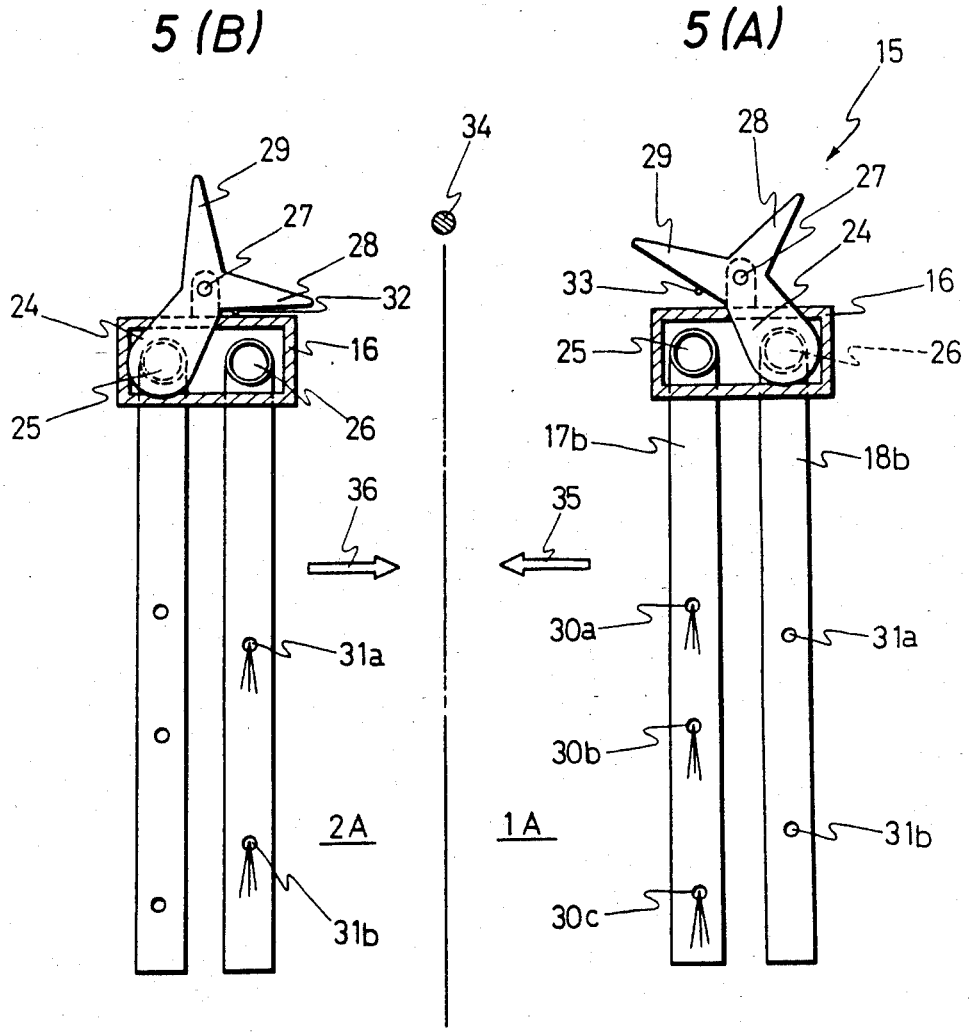
FIG. 5 is a partially sectional front elevation showing one example of the air injection position switching device of the common cleaner.

In the present embodiment, therefore, the ducts 17*a* and 17*b*, and 18*a* and 18*b* especially for the spinning frame and the winder are provided such that the compressed air supply passages from the blower 16 may be switched by means of a switching shutter 24. As better seen from FIG. 5, more specifically, the ducts 17*b* and 18*b* are opened at openings 25 and 26 in the blower 16 which is placed on the rail 14, and the switching shutter 24 for selectively shutting off the aforementioned openings 25 and 26 is pivotally mounted on a pivot pin 27. The other end portion of the shutter 24 is formed into bifurcated levers 28 and 29. The aforementioned duct 17*b* is provided for the spinning frame and is formed at its three portions, for example, with air injection ports 30*a*, 30*b* and 30*c*, whereas the duct 18*b* for the winder is formed at its two portions with air injection ports 31*a* and 31*b*. Numerals 32 and 33 indicate stoppers for the levers 28 and 39. Moreover, a shutter switching pin 34 is fixed on the rail 14 at one portion between the spinner area 1A and the winder area 2A.

Now, when the cleaner 15 moves in the direction of arrow 35 from the spinner area 1A, the shutter 24 is in a position to shut off the duct 18*b* for the winder. The compressed air is injected from the injection ports 30*a*, 30*b* and 30*c* of the duct 17*b* for the spinning frame. The lever 28 of the shutter 24 engages with the pin 34 at the boundary between the spinner area 1A and the winder area 2A. As a result of the movement of the cleaner 15, moreover, the lever 28 is turned clockwise on the pivot pin 27. The shutter 24 is turned to a position to shut off the opening of the duct 17*b* for the spinning frame. The compressed air flows through the opening 26 of the winder duct 18*b* so that the air injection is started from the injection ports 31*a* and 31*b* toward the predetermined portions of the winder. When the cleaner 15 moves in the direction of arrow 36 from the winder area 2A to the spinner area 1A, on the contrary, the lever 29 comes into engagement with the pin 34 to turn counter-clockwise thereby to shut off the winder duct. As a result, the supply of the compressed air to the special ducts is mechanically switched merely by reciprocally moving the cleaner.

Figure 6:
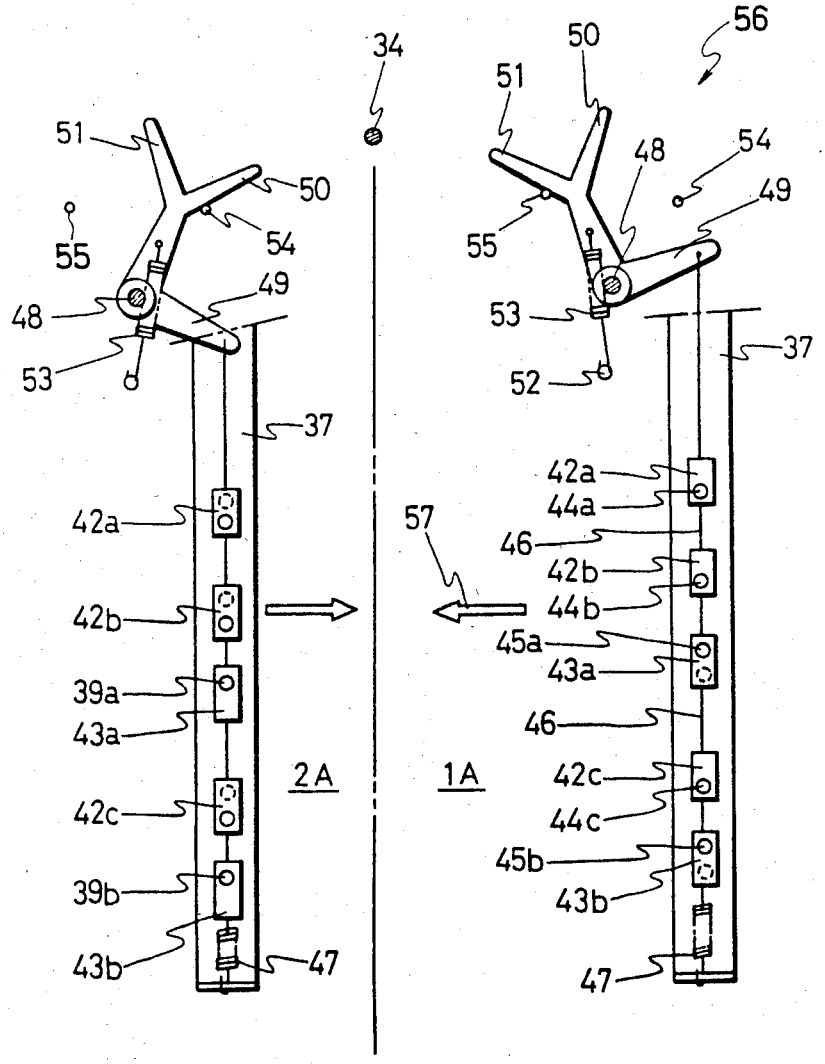
FIG. 6 is a front elevation showing another example of the same device.
Figure 7:
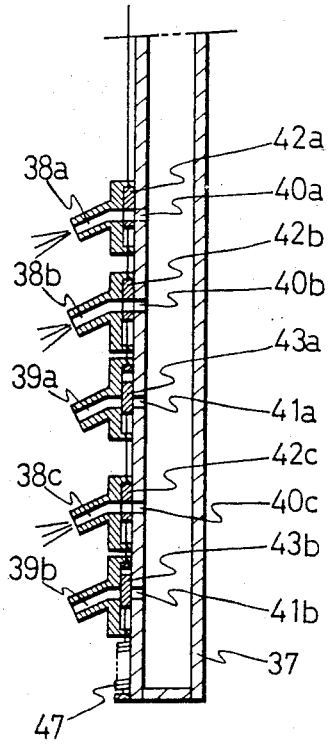
FIG. 7 is a sectional side elevation showing the shutter position in the state of FIG. 6(A).

FIGS. 6 and 7 show another embodiment of the ducts of the aforementioned cleaner, in which one duct 37 can be used commonly for the spinner are and the winder area. Specifically, one duct 37 is formed with both injection ports 38*a*, 38*b* and 38*c* for the spinning frame and injection ports 39*a* and 39*b* for the winder, and moving shutters 42*a*, 42*b*, 42*c*, 43*a* and 43*b* are so interposed between the communication ports 40*a*, 40*b*, 40*c*, 41*a* and 41*b* of the duct body 37 and the aforementioned injection ports 38*a*, 38*b*, 38*c*, 39*a* and 39*b* that they can vertically slide. Said shutters 42*a* to 43*b* are respectively formed with air passages 44*a*, 44*b*, 44*c*, 45*a* and 45*b* and closing portions for shutting off the aforementioned injection ports. The individual shutters 42*a* to 43*b* are connected to each other by means of connecting members such as strings, chains or rods so that they can move together up and down at an equal pitch.

Moreover, the lower end of the aforementioned connecting members 46 is connected to the body of the duct 37 via spring 47, whereas the upper end of the same is connected to one end of a switching lever 49 which can turn on a pivot pin 48 fixed on the moving cleaner. The other end of the aforementioned switching lever 49 is formed into bifurcated levers 50 and 51, and there is mounted between the switching lever 49 and a fixed pin 52 a spring 53, which is made movable across the pivot pin 48 in accordance with the turns of the switching lever 49 thereby to conduct the so-called "snap action", by which the lever 49 is biased clockwise or counter-clockwise until it is positioned to abut against stoppers 54 or 55. At the boundary between the spinner area 1A and the winder area 2A, moreover, the pin 34 similar to that of the foregoing embodiment is fixed on the rail and positioned to engage either the bifurcated lever 50 or 51.

In the spinner area 1A, the result is that the bifurcated lever 51 of the switching lever 49 is positioned to abut against the stopper 55, as shown in FIG. 6. The switching shutters 42*a* to 43*b* of the individual injection ports 38*a* to 39*b* are at their upper positions, and the air passages 44*a*, 44*b* and 44*c* of the shutters 42*a*, 42*b* and 42*c* of the injection ports 38*a*, 38*b* and 38*c* are aligned with the injection ports so that the compressed air is injected to the predetermined portions of the spinning frame.

When the aforementioned cleaner 56 moves in the direction of arrow 57 to reach the boundary, the bifurcated lever 50 comes into engagement with the pin 34 so that the switching lever 49 turns clockwise on the pivot pin 48 against the force of the spring 53 in accordance with the movement of the cleaner until it is turned to the position where the lever 50 abuts against the stopper 54. At this time, the cleaner 56 is already in the winder area 2A. In other words, the switching lever 49 comes into the state of FIG. 6(B), in which the switching shutters 42*a* to 43*b* of the individual injection ports 38*a* to 39*b* take their lower positions so that the injection ports 38*a*, 38*b* and 38*c* for the spinner area are shut off by the shutters whereas the injection ports 39*a* and 39*b* for the winder area renew their communications with the duct communication ports 41*a* and 41*b*.

Thus, the compressed air injection ports formed in one duct are selectively switched merely as a result that the cleaner moves back and forth along the spinning winder. Moreover, the ducts can be used commonly for the spinner area and the winder area so that the weight of the moving parts can be reduced.

In FIGS. 1 to 5, incidentally, the ducts 17*a* and 18*a* at one side of the spinning winder can be used as compressed air blow-off ones whereas the ducts 17*b* 18*b* at the other side can be used as suction ones. In this case, the flies sucked are once stored in the fly box of the cleaner 15 during the running operation, and the flies in the box are discharged by a fly waste removing device 58, when they reach one end portion, and are stored in a duct box 59 within the workable range of workers until they are suitably removed by them.

What is claimed is

1. In a spinning winder in which a spinning frame and a winder are connected by way of a spinning bobbin passage and/or an empty bobbin passage, a fly removing system characterized: in that the fly removing system includes a ceiling rail extending in the longitudinal direction between a spinner area and a winder area, and a cleaner which is then placed along the rail and is made reciprocally movable, said cleaner comprising a blower, and a plurality of ducts which have openings at the blower and have air injection ports and/or air suction ports formed therein at positions within said ducts which are adjacent to those portions of said spinner area where said flies are located.

2. In a spinning winder in which a spinning frame and a winder are connected by way of a spinning bobbin passage and/or an empty bobbin passage, a fly removing system characterized: in that the fly removing system includes a ceiling rail extending in the longitudinal direction between a spinner area and a winder area, and a cleaner which is placed along the rail and is made reciprocally movable, said clearner comprising a blower and a plurality of ducts which have openings at the blower and have air injection ports and/or suction ports formdd in suitable position thereof, wherein said ducts include ducts which act in the spinner area and ducts which act in the winder area, and a switching shutter for selectively shutting off the openings of the ducts is pivotally mounted on a pivot pin.

3. The system as claimed in claim 2, wherein a shutter switching pin is fixed on the rail at a portion between the spinner area and the winder area and the pin can engage with one of bifurcated levers which are formed at the one end portion of the switching shutter to turn the switching shutter about the pivot pin so that the switching shutter shuts off either of the openings of the ducts for a spinning frame or a winder.

4. The system as claimed in claim 1, wherein said duct is formed with both injection ports and/or suction ports for the spinning frame, and injection ports and/or suction ports for the winder, communication ports provided on the duct body, and a moving shutter slidably interposed between the injection or suction ports and the communication ports, said moving shutter being formed with air passages and closing portions for shutting off the aforementioned injection or suction ports so that the moving shutter can close or open either of the injection or suction ports for the spinning frame and the injection or suction port for the winder.

5. The system as claimed in claim 4, wherein the upper end of the moving shutter is connected to one end of a switching lever which can turn on a pivot pin fixed on the cleaner and the lower end of the moving shutter is connected to the end of the duct through a spring so that the moving shutter is moved in accordance with the turns of the switching lever.

6. The system as claimed in claim 5, wherein a switching lever pin is fixed on the rail at a portion between the spinner area and the winder area and the pin can engage with one of bifurcated levers which are formed at one end portion of the switching lever to turn the lever about the pivot pin so that the moving shutter is moved in vertical direction.

7. A fly removal system in which a spinning frame having a spinner area and a winder having a winder area are interconnected by a bobbin passage, comprising:

a common cleaner adapted to sequentially clean both the spinner area and the winder area; and means for reciprocally moving the cleaner between said spinner area and said winder area to remove flies therefrom.

8. A fly removal system according to claim 7, further comprising:

a first duct positioned on said common cleaner for cleaning said spinner area; and a second duct positioned on said common cleaner for cleaning said winder area.

9. A fly removal system according to claim 8, further comprising:

switching means for closing said first duct when said cleaner cleans said winder area, and for alternatively closing said second duct when said cleaner cleans said spinner area.

10. A fly removal system according to claim 7, further comprising:

at least one duct located on said common cleaner;

a first set of ports located on said at least one duct for cleaning said spinner area; and a second set of ports located on said at least one duct for cleaning said winder area.

11. A fly removal system according to claim 10, further comprising:

a switching means for closing said first set of ports when said cleaner cleans winder area, and alternatively closing said second set of ports when said cleaner cleans spinner area.

12. An apparatus for removing fly waste from a system having an interconnected spinning frame and winder, and adapted for use with air flow means for producing a flow of compressed air, comprising;

duct means reciprocally movable between said spinning frame and said winder and in communication with said air flow means for directing the flow of said compressed air, said duct means having a first set and a second set of apertures through which the flow of air may pass, said first set of apretures being aligned with respect to predetermined portions of said spinning frame where said duct means is adjacent said spinning frame, and said second set of apertures being aligned with respect to predetermined portions of said winder when said duct means is adjacent said winder; and selection means for selectively directing said compressed air through said first set of apertures when said duct means is adjacent said spinning frame and through said second set of apertures when said duct means is adjacent said winder.

* * * * *